US005223853A

United States Patent [19]

Wysocki et al.

[11] Patent Number: 5,223,853

[45] Date of Patent: Jun. 29, 1993

[54] ELECTRONIC SPOT SIZE CONTROL IN A THERMAL INK JET PRINTER

[75] Inventors: Joseph J. Wysocki; William G. Hawkins; Gary A. Kneezel, all of Webster; Richard V. LaDonna, Fairport; Joseph F. Stephany; Thomas A. Tellier, both of Williamson; Thomas E. Watrobski, Rochester, all of N.Y.

[73] Assignee: Xerox Corporation, Stamford, Conn.

[21] Appl. No.: 840,239

[22] Filed: Feb. 24, 1992

[51] Int. Cl.[5] ..... B41J 2/05

[52] U.S. Cl. ..... 346/1.1; 346/140 R

[58] Field of Search ..... 346/140 R, 76 PH, 1.1

[56] References Cited

U.S. PATENT DOCUMENTS

| | | | |
|---|---|---|---|
| 4,736,089 | 4/1988 | Hair et al. | 219/216 |
| 4,774,530 | 9/1988 | Hawkins | 346/140 |
| 4,791,435 | 12/1988 | Smith et al. | 346/140 R |
| 4,899,180 | 2/1990 | Elhatem et al. | 346/140 R |
| 4,980,702 | 12/1990 | Kneezel et al. | 346/140 R |
| 5,023,626 | 6/1991 | Kawamura | 346/140 R X |
| 5,036,337 | 7/1991 | Rezanka | 346/140 R X |
| 5,121,135 | 6/1992 | Deguchi | 346/76 PH |

FOREIGN PATENT DOCUMENTS 201681 11/1983 Japan .

OTHER PUBLICATIONS

World Patent Application No. 90/10541, Josef Pöppel. "Process for Varying the Droplet Size in Ink Printers", Application Date: Jan. 26, 1990.

World Patent No. 90/10540, Siemens Aktiengesellschaft, "Process and Device for Optimizing Pressure Pulses in Ink Printers Operated by Thermal Converters", Application Date: Jan. 25, 1990.

*Primary Examiner*—Joseph W. Hartary

*Attorney, Agent, or Firm*—R. Hutter

[57] ABSTRACT

A system controls an ink jet printing apparatus for propelling ink jet droplets on demand from a printhead having a plurality of drop ejectors. In the printhead, each ejector includes a heating element actuable in response to electrical input signals, each input signal having an amplitude and a time duration, selectably applied to the heating element to produce a temporary vapor bubble and cause a quantity of ink to be emitted for the creation of a mark on a copy sheet. The temperature of ink in the printhead is sensed, and a combination of power level and time duration of the electrical input signal for the heating element to result in a desired size of the mark of the copy sheet is selected, by entering the sensed temperature of the ink into a predetermined function relating the energy of the electrical input signal to the corresponding resulting size of the mark on the copy sheet.

25 Claims, 8 Drawing Sheets

ELECTRONIC SPOT SIZE CONTROL IN A THERMAL INK JET PRINTER

FIELD OF THE INVENTION

The present invention relates to a control system for a thermal ink jet printer. Specifically, the present invention is a control system for the spot size associated with an ink jet printhead, which responds to the temperature of the ink in the printhead.

BACKGROUND OF THE INVENTION

In thermal ink jet printing, droplets of ink are selectively emitted from a plurality of drop ejectors in a printhead, in accordance with digital instructions, to create a desired image on a copy surface. The printhead typically comprises a linear array of ejectors for conveying the ink to the copy sheet. The printhead may move back and forth relative to a surface, for example to print characters, or the linear array may extend across the entire width of a copy sheet (e.g. a sheet of plain paper) moving relative to the printhead. The ejectors typically comprise capillary channels, or other ink passageways, which are connected to one or more common ink supply manifolds. Ink from the manifold is retained within each channel until, in response to an appropriate digital signal, the ink in the channel is rapidly heated and vaporized by a heating element disposed within the channel. This rapid vaporization of the ink creates a bubble which causes a quantity of ink to be ejected through the nozzle to the copy sheet. One patent showing the general configuration of a typical ink jet printhead is, for example, U.S. Pat. No. 4,774,530 to Hawkins.

When a quantity of ink, in the form of a droplet, is ejected from the ejector to a copy surface, the resulting spot becomes part of a desired image. Crucial to image quality in ink jet printing is a uniformity in spot size of a large number of droplets. If the volumes of droplets ejected from the printhead over the course of producing a single document are permitted to vary widely, this lack of uniformity will have noticeable effects on the quality of the image. Similarly, if volumes of droplets ejected from the printhead differ during subsequent printings of the same document, then printing stability cannot be maintained; this is particularly important in color printing. The most common and important cause of variance in the volume of droplets ejected from the printhead is variations in the temperature in the printhead over the course of use. The temperature of the liquid ink, before vaporization by the heating element, substantially affects both the density and the viscosity of the ink. These two ink properties substantially influence the resulting spot size on the copy surface. Control of temperature of the printhead, then, has long been of primary concern in the art.

In order to maintain a constant spot size from an ink jet printhead, various strategies have been attempted. One example is U.S. Pat. No. 4,899,180 to Elhatem et al., assigned to the assignee of the present application. In this patent the printhead has integrated into it a number of heater resistors and a temperature sensor which operate to heat the printhead to an optimum operating temperature, and maintain that temperature regardless of local temperature variations.

U.S. Pat. No. 4,791,435 to Smith et al. discloses an ink jet system wherein the temperature of the printhead is maintained by using the heating elements of the printhead not only for ejection of ink but for maintaining the temperature as well. The printhead temperature is compared to thermal models of the printhead to provide information for controlling the printhead temperature. At low temperature, low energy pulses are sent to each channel, or nozzle, below the voltage threshold which would cause a drop of ink to be ejected. Alternatively, the printhead is warmed by firing some droplets of ink into an external chamber or "spittoon," as opposed to the copy surface.

PCT application 90/10541 describes a printhead in which the heating cycle for the ink is divided into several partial cycles, only the last of which initiates bubble formation and ejection of a droplet. In this printhead, therefore, the liquid ink is first preheated to a preselected temperature, wherein the ink will have known volume and viscosity characteristics, so that the behavior of the ink will be predicatable at the time of firing.

PCT application 90/10540 discloses a printhead control system wherein the temperature of the liquid ink is compared with a predetermined threshold value, and if it exceeds this threshold value, the pulse energy (proportional to the square of the voltage to the heating element times the time duration of the pulse) is reduced. According to this patent, the pulse energy may be varied by controlling either the voltage, the pulse duration, or both.

U.S. Pat. No. 4,736,089 to Hair et al. discloses a thermal printhead (as opposed to an ink-jet printhead) wherein printhead temperature is sensed by a voltage generating diode on the printhead itself. A detected temperature of the printhead is used to establish a preselected reference level. Bi-stable means are coupled to the thermal printhead to print or not print at a given time. Control means are used to turn the bi-stable means on when the controlled voltage is less than the reference level related to the temperature, and turns the bi-stable means off when the controlled voltage exceeds the preselected reference level, thus causing the time duration of a voltage pulse to the thermal printing means to be dependent on temperature.

U.S. Pat. No. 4,980,702 to Kneezel discloses a thermal ink jet printhead wherein outputs from a temperature sensor in the printhead are compared to a high or low level temperature reference. If the sensed printhead temperature is below the reference value, power to the heater in the printhead is turned on. If the temperature sensed is too high, the heater is turned off. The printhead is configured so that the temperature sensor and heater in the printhead are in close proximity.

It is an object of the present invention to provide a system for controlling the spot size of droplets emitted from an ink jet printhead in response to changes in temperature.

It is another object of the present invention to provide such a system in which modifications to the system for various specific ink jet printing purposes may be easily incorporated.

It is another object of the present invention to provide such a system which controls spot size without requiring direct control of the temperature of the ink in the printhead.

Other objects will appear hereinafter.

SUMMARY OF THE INVENTION

In accordance with the above-stated objects, the present invention is a control system for an ink jet printing apparatus for propelling ink jet droplets on demand from a printhead having a plurality of drop ejectors. In the printhead, each ejector includes a heating element actuable in response to electrical input signals, each input signal having an amplitude and a time duration, selectably applied to the heating element to produce a temporary vapor bubble and cause a quantity of ink to be emitted for the creation of a mark on a copy sheet. The temperature of ink in the printhead is sensed, and a combination of power level and time duration of the electrical input signal for the heating element to result in a desired size of the mark on the copy sheet is selected, by entering the sensed temperature of the ink into a predetermined function relating the energy of the electrical input signal to the corresponding resulting size of the mark on the copy sheet.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
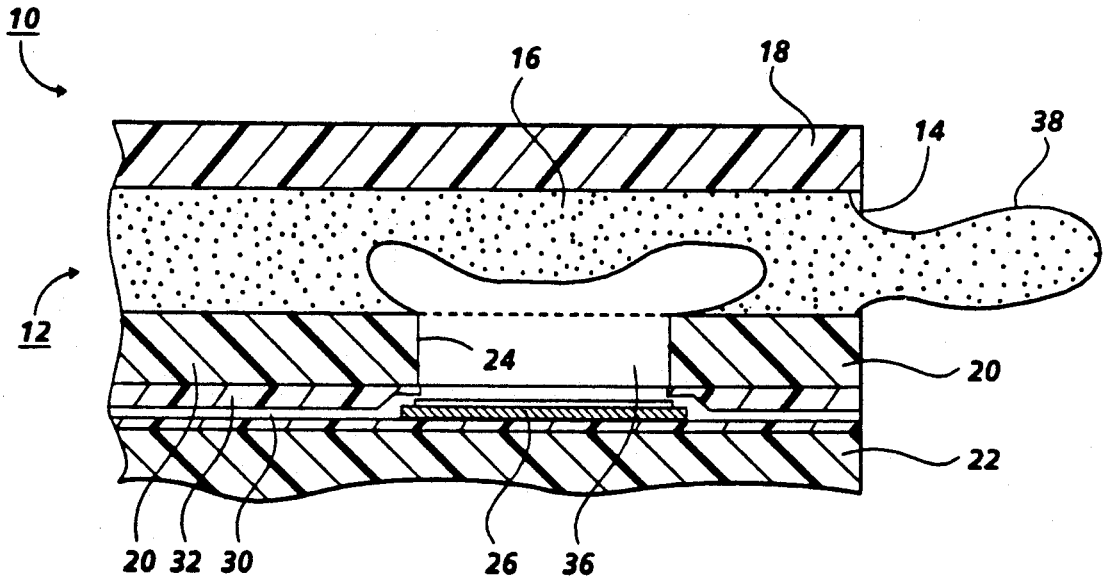
FIG. 1 PRIOR ART
FIG. 1 is a sectional elevational view of a nozzle of an ink jet printhead.

FIG. 1 is a sectional elevational view of a drop ejector of an ink jet printhead, one of a large plurality of such ejectors which would be found in one version of an ink jet printhead. Typically, such ejectors are sized and arranged in linear arrays of 300 ejectors per inch. As will be used in the detailed description, a silicon member having a plurality of channels for drop ejectors defined therein, typically 128 ejectors, is known as a "die module" or "chip." A thermal ink-jet apparatus may have a single chip which extends the full width of a copy sheet on which an image is to be printed, such as 8½ inches or more, although many systems comprise smaller chips which are moved across a copy sheet in the manner of a typewriter, or which are abutted across the entire substrate width to form the full-width printhead. In designs with multiple chips, each chip may include its own ink supply manifold, or multiple chips may share a single common ink supply manifold.

Each ejector, generally indicated as 10, includes a capillary channel 12 which terminates in an orifice 14. The channel 12 regularly holds a quantity of ink 16 which is maintained within the capillary channel 12 until such time as a droplet of ink is to be ejected. Each of a plurality of capillary channels 12 are maintained with a supply of ink from an ink supply manifold (not shown). The channel 12 is typically defined by an abutment of several layers. In the ejector shown in FIG. 1, the main portion of channel 12 is defined by a groove anisotropically etched in an upper substrate 18, which is made of a crystalline silicon. The upper substrate 18 abuts a thick-film layer 20, which in turn abuts a lower substrate 22.

Sandwiched between thick film layer 20 and lower substrate 22 are electrical elements which cause the ejection of a droplet of ink from the capillary channel 12. Within a recess 24 formed by an opening in the thick film layer 20 is a heating element 26. The heating element 26 is typically protected by a protective layer 28 made of, for example, a tantalum layer having a thickness of about one micron. The heating element 26 is electrically connected to an addressing electrode 30. Each of the large number of nozzles 10 in a printhead will have its own heating element 26 and individual addressing electrode 30, to be controlled selectively by control circuitry, as will be explained in detail below. The addressing electrode 30 is typically protected by a passivation layer 32.

When an electrical signal is applied to the addressing electrode 30, energizing the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of a copy sheet. The "copy sheet" is the surface on which the mark is to be made by the droplet, and may be, for example, a sheet of paper or a transparency.

As mentioned above, the size of the spot created by a droplet 38 on a copy sheet is a function of both the physical quality of the ink at the point just before vaporization, which is largely a function of the temperature of the ink, and the kinetic energy with which the droplet is ejected, which is a function of the electrical energy to the heating element 26. Thus, in a control system for the spot size of the droplet, the power to the heating element can be made dependent on the sensed temperature of the liquid ink. In the present invention, a sensed temperature of the printhead is used ultimately to control the power level and/or time duration of an input signal pulse.

The present invention operates on the principle of selecting a "best," or at least suitable, combination of power level and time duration of an input signal pulse to the heating element 26 in order to obtain a spot of desired size on the copy sheet. In selecting a combination of power level and time duration of the signal pulse, any of a number of variables and parameters may be taken into account: the specific characteristics of a given type of ink, the type of copy sheets, the temperature-response characteristics of the temperature sensing means and, most importantly, the temperature of the liquid ink in the channel 12 of the drop ejector 10 at the moment just before the heating element 26 is energized. In the preferred embodiment of the invention, most of the conditions required to obtain the desired combination of power level and time duration are set out as parameters for equations into which the sensed temperature of the ink is entered as a variable. When a given condition is changed (for example, changing from a paper copy sheet to a transparency, or loading the printhead with a different type of ink), the equation is changed and the temperature is entered into the new equation. The apparatus of the invention may actually perform calculations in the course of operation, or the apparatus may employ electronic look-up tables which are derived from predetermined calculations based on the necessary equations.

In the operation of a drop ejector as shown in FIG. 1, the temperature responsiveness of the ejector and the ink therein reflects a complicated process. Drops are ejected from the ejector by activating heating element 26; in order to obtain the desired spot size, it is necessary to take into account the temperature of the liquid ink at the moment before ejection. However, the very act of ejection itself causes a general increase in temperature around the ejector, because of the activation of the heating element. Some of this added heat escapes with the ejected ink itself, but a significant portion is retained in the chip. Over even a short period of use, the temperature of the ejector itself and therefore ink coming into the ejector will increase substantially. Most prior art arrangements emphasize simply regulating the temperature of the ejector, that is preventing it from getting too hot, in order to keep the temperature of the ink within a manageable range. In the present invention, the temperature of the ink is not regulated; rather, the control system simply reacts to the sensed temperature of the ink, essentially recalculating the necessary energy to the ejector with every ejection or number of ejections. The present invention is thus superior to prior art systems which merely compare the sensed temperature of the ink to a threshold and reduce or increase the energy accordingly. The system of the present invention guarantees the correct energy to the heating element to obtain the uniform spot size, without the "learning" or "recovery" time which a feedback-based system may require.

Figure 2A:
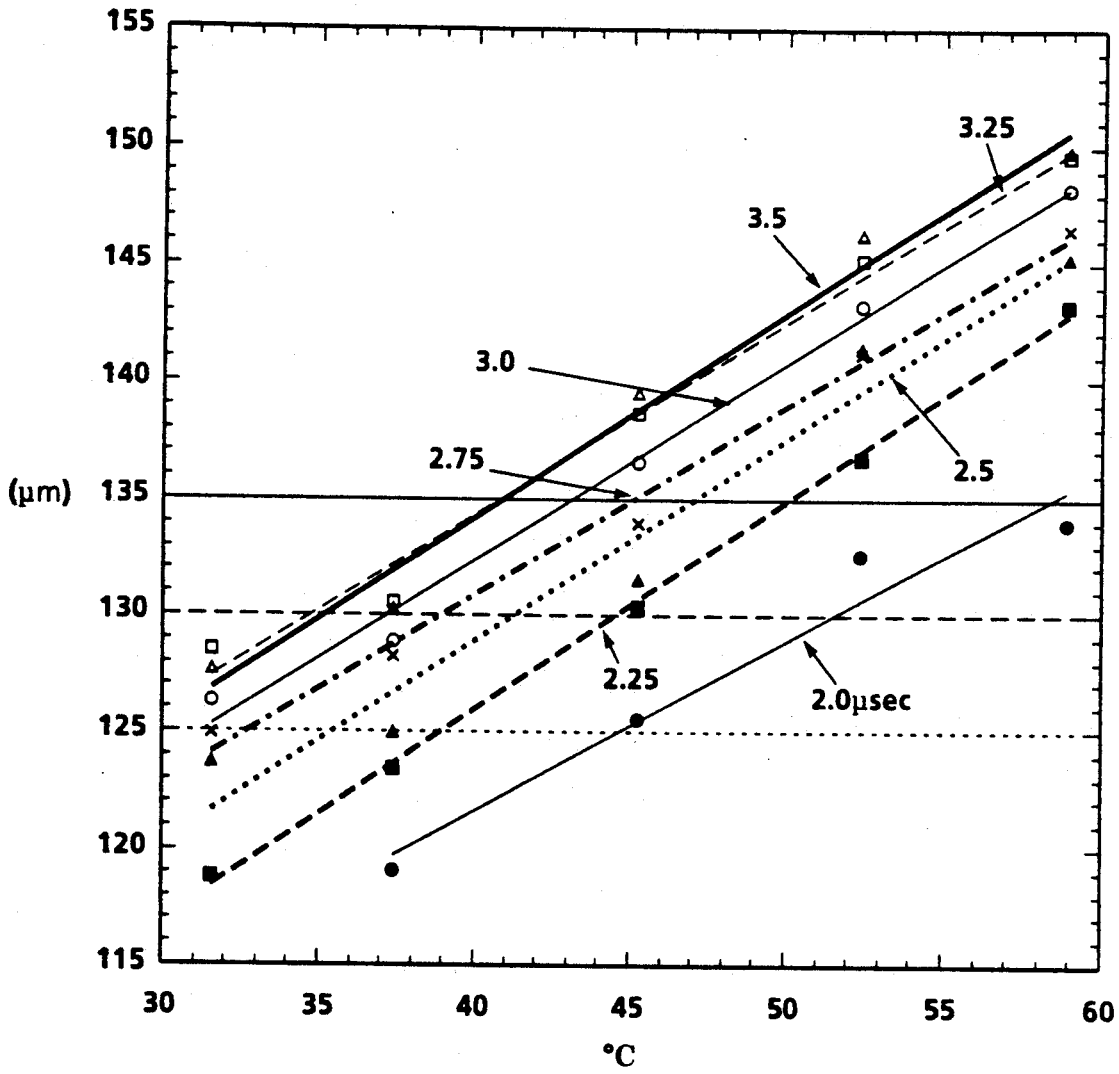
FIG. 2A–2C are a series of graphs showing the interrelationships among various variables and parameters which are relevant to the control principle of the present invention.
Figure 2B:
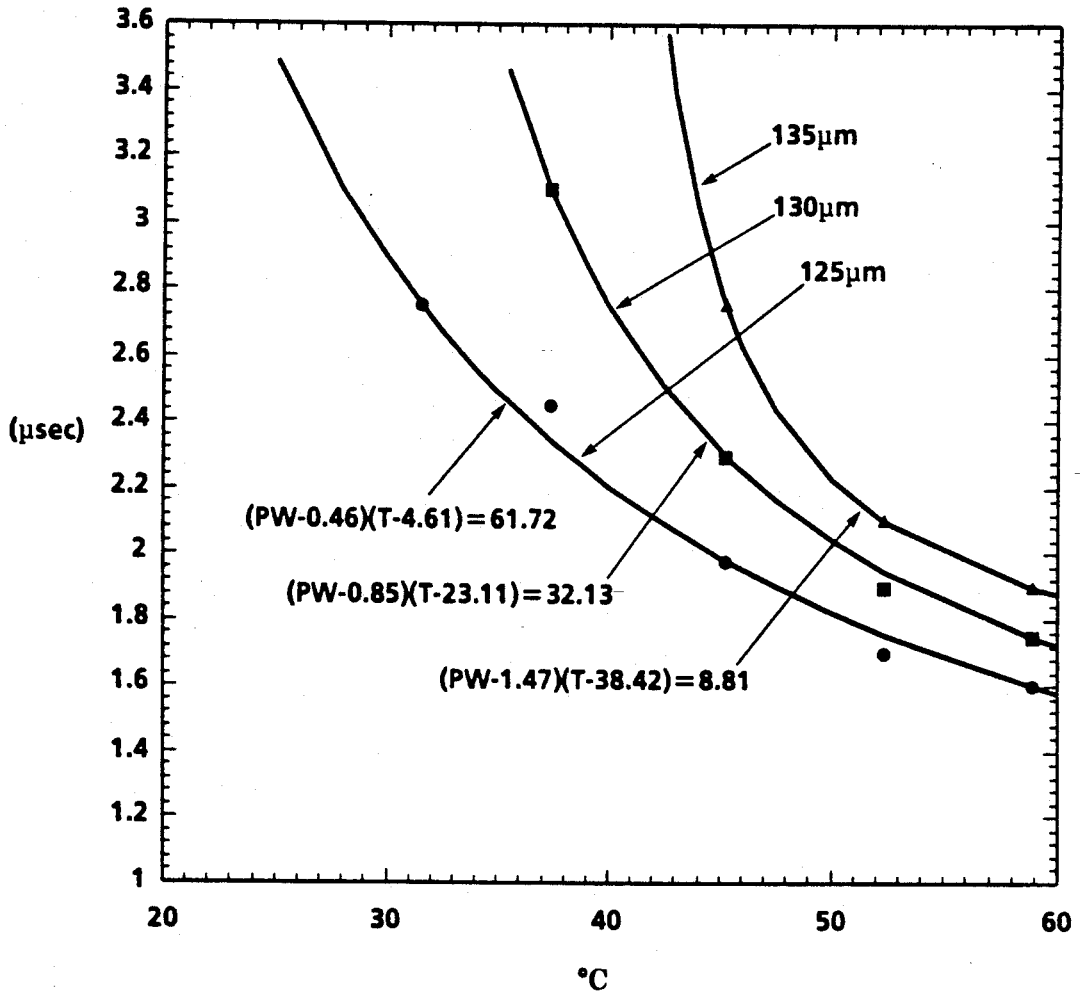
Figure 2C:
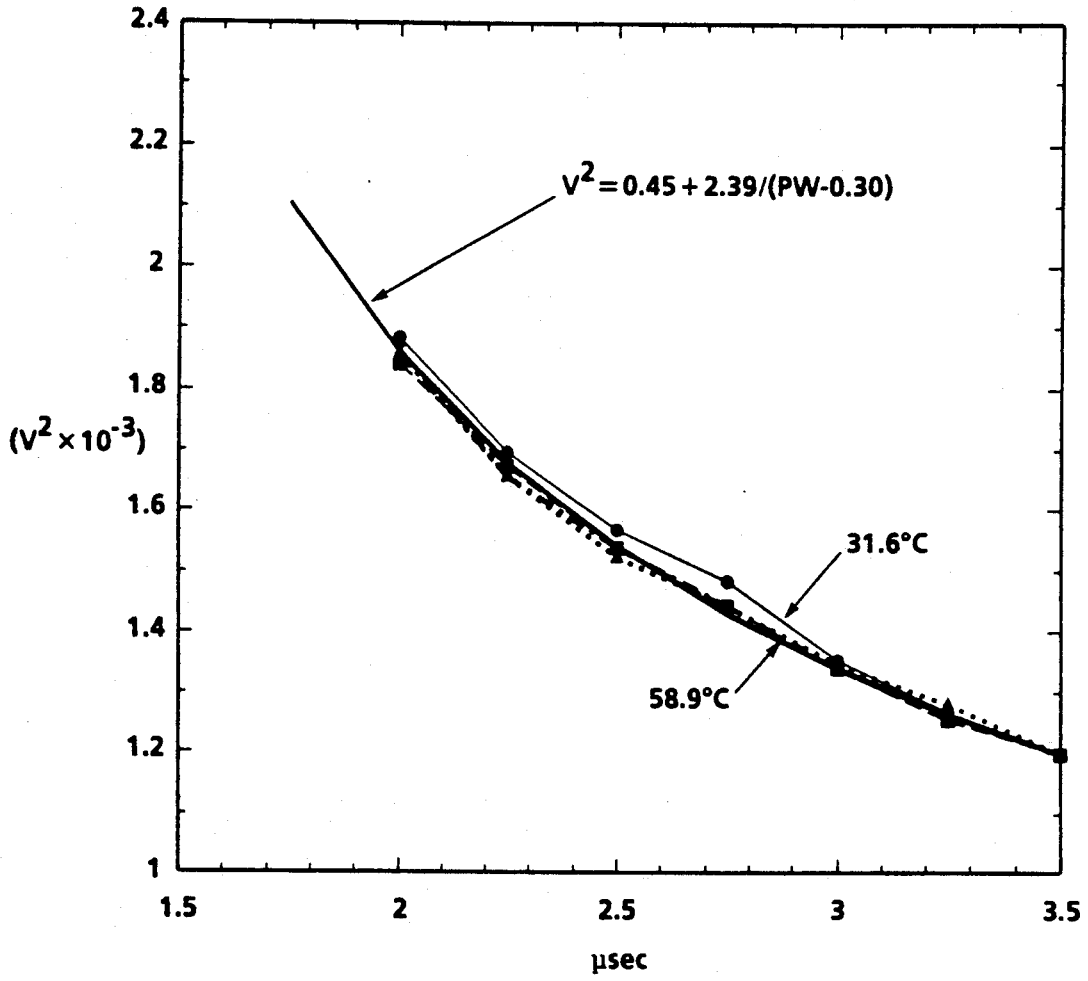

FIGS. 2A, 2B and 2C are graphs illustrating the relationships among temperature of liquid ink, pulse width (the duration of the input signal to the heating element 26), and burn voltage (the voltage amplitude of the input signal, being of course related to the power of the input signal), as these factors relate ultimately to the spot size of a mark on a copy sheet created by an ejected ink droplet. The examples shown in the Figures are given to illustrate these interrelationships for one typical printhead; the actual data for the graphs will be different for different types of printhead, but in the preferred embodiment of the invention, the empirical data by which the printhead is controlled may be derived from experiments with the actual printhead. FIG. 2A is a graph showing the relationship between spot size (the diameter of the spot, in micrometers) as a function of the temperature of the liquid ink for a variety of pulse widths. As is apparent from the graph, the relationship is highly linear (with a correlation coefficient of 0.96 or higher in each case) for all practical pulse widths, from 2.0 to 3.5 microseconds.

The information in the graph of FIG. 2A can be restated more usefully in the graph of FIG. 2B, which shows pulse width as a function of temperature for a variety of potential spot sizes. As is apparent from the graph, this function is a series of hyperbolic curves for different spot sizes. Since a predetermined spot size is usually the most important desired result of the operation of the drop ejector, the data from this graph could be used to select the necessary pulse width, on the y-axis, in response to a sensed temperature of the liquid ink, from the x-axis.

In addition to selecting the necessary pulse width for a desired spot size, it is also necessary to determine a usable burn voltage consistent with the pulse width. It is important to note that, in the actual operation of a drop ejector, the energizing of the heating element will cause the vapor in the channel of the ejector to expand until the drop is ejected; any energy expended in the heating element after ejection of the droplet will simply be wasted and would serve only to heat up the chin unnecessarily. Conversely, although a high burn voltage will allow the drop to be ejected faster, it is helpful from the perspective of durability of the printhead not to have a burn voltage higher than necessary for a given pulse width. Thus, for a given set of parameters and a given sensed ink temperature, there will be a range of "optimum" combinations of pulse widths and burn voltages, which are preferable not only from the stand point of constant spot size, but also of these secondary considerations such as printhead durability and avoiding wasted energy. In a preferred embodiment of the invention, the preferred combinations will reflect a burn voltage on the order of 110% of that necessary to cause ejection at a given pulse width.

FIG. 2C is graph showing a typical relationship between burn voltage and pulse width with ink temperature as a parameter. In this case, it can be seen in that the relationship between burn voltage squared and pulse width creates a reasonably consistent curve over a wide range of ink temperatures (just under 30 Celsius degrees). Thus, for the particular example given in these FIGS., the predetermined spot size and a sensed temperature can be entered into the graph of FIG. 2B to obtain a suitable pulse width, and this suitable pulse width can then be entered into the equation of FIG. 2C to obtain the necessary value of burn voltage. The FIGS. 2A–2C represent one example of finding the most suitable combination of burn voltage and pulse width (or, in a more general sense, power level and duration) using empirically-derived functions. These specific functions may vary for different types of ink or different types of printhead, but the salient feature is that the sensed temperature is entered into at least one function relating the energy of the input signal (burn voltage, pulse width, or both) to a predetermined desired spot size.

Figure 3:
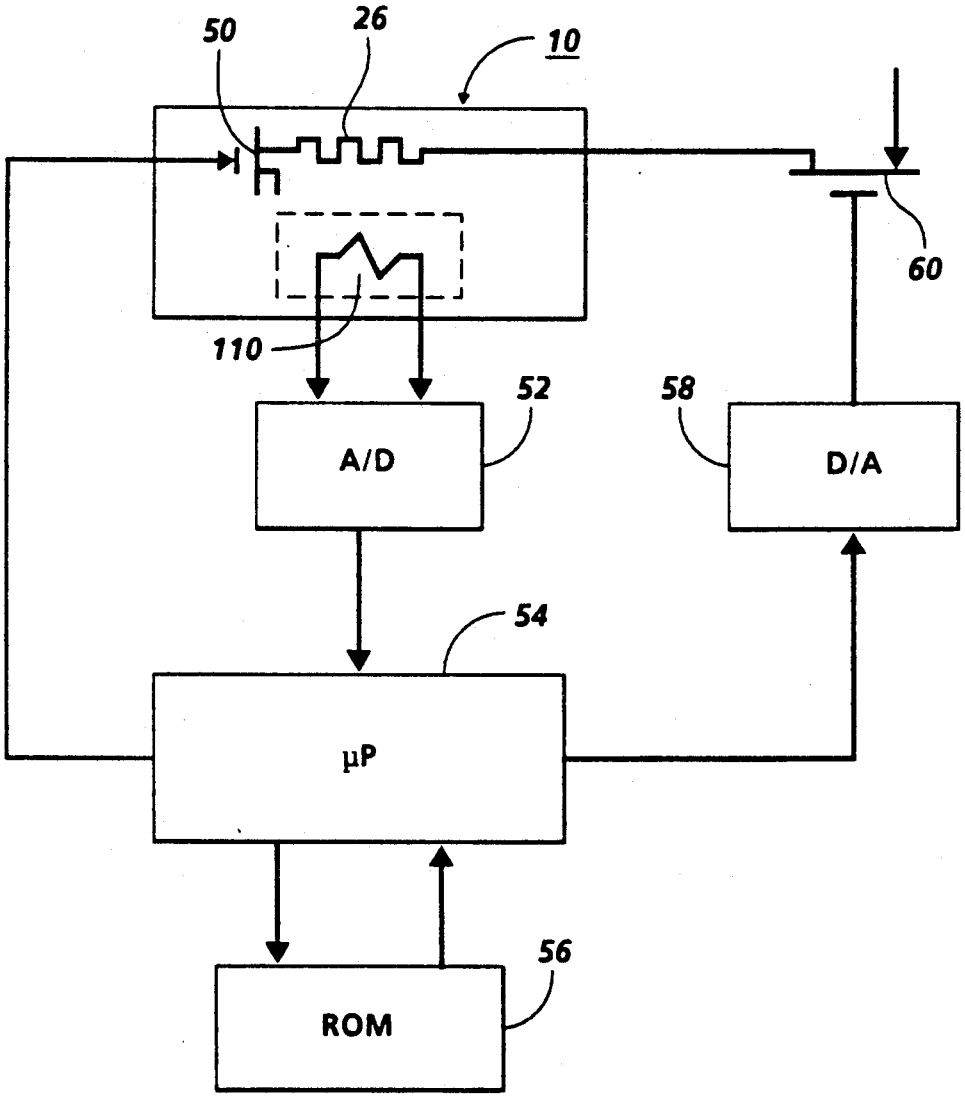
FIG. 3 is a systems diagram illustrating one embodiment of the control system of the present invention.

FIG. 3 is a systems diagram illustrating the basic elements of one embodiment of the present invention. The important elements of a typical drop ejector (such as the "side-shooter" shown in FIG. 1) are shown in simplified form and indicated generally in the box marked 10. Drop ejector 10 includes, among other elements, a heating element 26, an ink temperature sensing element, here shown as a thermistor 110, and a drive transistor 50. Thermistor 110 is adapted to produce a voltage proportional to the sensed temperature. Although the thermistor 110 may actually sense the temperature of the chip and not of the ink itself, it will be appreciated that the system may be modified (for example, by internal software) to take the structure of the chip into account to arrive at an acceptably accurate temperature reading of the ink itself.

This voltage from thermistor 110 is entered into an analog-to-digital converter 52, and a digital word representative of the sensed ink temperature is sent to microprocessor 54. Microprocessor 54, in turn, accesses a read-only memory (ROM) 56 which is loaded with look-up tables reflective of the temperature-sensitive characteristics of the ejector and the ink therein, taking into account other parameters such as type of copy sheet and desired spot size. Indeed, the ROM 56 preferably will include a plurality of selectable look-up tables which the user can easily choose among for a particular job. The microprocessor 54 reads the digital word representative of the sensed ink temperature and responds by "looking up" the suitable combination of power level and pulse duration for the sensed ink temperature, from the selected look-up table in ROM 56. These look-up tables are typically derived from empirical data about the printhead, in the manner of the data in FIGS. 2A-2C.

The combination of power level and pulse duration selected from the look-up table in ROM 56 is loaded back into the microprocessor 54, which then outputs a pulse of the selected duration, and a digital word representative of the desired power level (typically, the burn voltage). The pulse is sent to the drive transistor 50 in the ejector 10, while the digital word is sent to digital-to-analog converter 58. The output from digital-to-analog converter 58, may be used, for example, to control the base of a power transistor 60, which is connected to an external power supply, to drive heater 26 at the desired burn voltage. In this way the pulse to drive transistor 50 controls the pulse duration while the signal to power transistor 60 controls the power level.

It will be apparent that numerous look-up tables, each reflective of a particular combination of printing conditions, can be made available to the user. The user may choose not only a desired spot size, but also enter in data relating to, for example, a particular type of ink being used or a particular type of copy sheet. It is likely that different types of ink (of different colors, for example) will have different temperature-sensitive characteristics. In addition, in a color printer, which creates different colors by combining various amounts of cyan, yellow, magenta, or black ink, the user-adjustable spot size can be used to achieve the desired color balance. Another printing parameter which may have an effect on the quality of the printed image is the type of copy sheet being used, such as plain paper or a transparency. When the present invention is used for printing on transparencies, it has been found that selection of a larger than normal spot size is advantageous in order to achieve the desired saturation of ink without a penalty in printing throughput. The actual combinations of power level and duration may be obtained through empirical data derived from experimentation with the actual apparatus.

With the control system of the present invention, it is possible to redetermine the appropriate combination of power level and duration after every cycle of ejection of ink from the ejectors, that is, substantially continuously. In a practical situation, the actuation of the heating element in the ejectors, or even neighboring ejectors, may cause the printhead in general, and the ink within the individual channels, to heat up to such an extent that a new combination will be required in the very next cycle. The system of the present invention is versatile enough to respond quickly to such temperature changes. The system may be adapted to sense the temperature of the ink following every cycle of emitting ink, or following some predetermined number of cycles, which may be desirable to accommodate, for example, the time-lag of any temperature-sensitive device, or at convenient breaks in the operation of the printhead, as when the printhead changes direction between printing swaths across a page.

Similarly, and equally importantly, it may be the case that certain parts of a printhead will be caused to be hotter than other parts in the course of printing a document. For example, in a full-page-width printhead, the ejectors toward the center of the printhead are more likely to be used than ejectors in positions corresponding to the margins of a document. Thus, with use, the center portions will become hotter. With the present invention, numerous temperature sensors may be employed (such as, for example, one sensor associated with each of several abutting chips forming a full-width printhead) and specific sets of ejectors may be controlled independently of others, so that certain ejectors will be controlled in accordance with temperature readings from the nearest temperature sensor. Thus, when a sensor in a "hot" part of a printhead senses a high temperature, such as on one chip, that chip may be controlled independently of a chip in a "cooler" part of the printhead.

In the embodiment of the invention shown in FIG. 3, the system is "digitized" to a maximum extent, and no calculations are actually made; the look-up tables in ROM 56 reflect predetermined calculations of the most suitable duration-power combinations. However, in another embodiment of the invention, a portion of the system may operate in an analog fashion.

Figure 4:
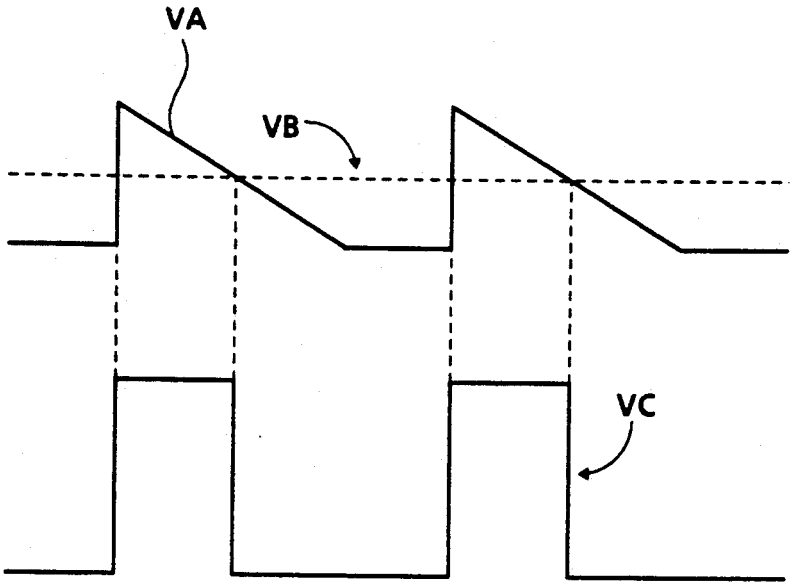
FIG. 4 is a set of waveform diagrams illustrating an analog embodiment of the control principle of the present invention.
Figure 5:
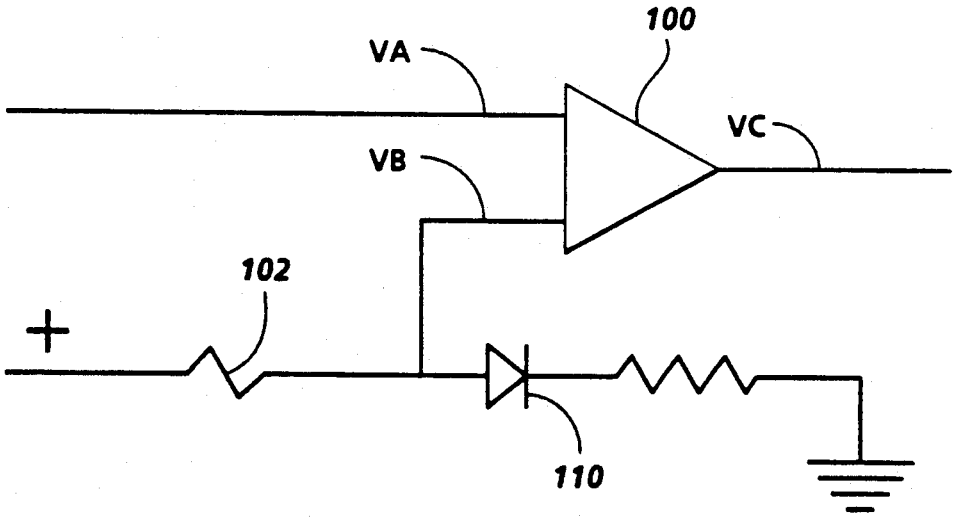
FIG. 5 is a simplified schematic diagram showing the relationships among the waveforms in FIG. 4 in a circuit incorporated in the present invention.

FIGS. 4 and 5 are a set of waveform diagrams, and a simplified circuit diagram, respectively, illustrating the general control principle of a more "analog" embodiment of the present invention. The input signal which is applied to addressing electrode 30 in ejector 10 (as can be seen in FIG. 1) is the result of two simultaneous input waveforms, shown in FIG. 4 as VA and VB. In this embodiment, VA is a ramp signal, or ramped firing pulse, characterized by an initial sharp increase in voltage followed by a relatively gradual decrease to a base voltage; other voltage profiles may be used, depending on circumstances. The VA ramped firing pulse is initiated for every cycle in which an ink droplet is to be emitted from the ejector. VB, in contrast, is a substantially constant voltage value related to the sensed temperature of liquid ink in the capillary channel 12 of the ejector 10 just before firing. The voltage amplitude of VB will vary only gradually with changes in the temperature of the liquid ink in the capillary channel 12; in the course of a cycle of the ramped firing pulse VA the value of VB will remain substantially constant. As illustrated in FIG. 5, these two waveforms VA and VB are sent together to a comparator 100, the output of which, shown as VC in the lower portion of FIG. 5, can be used as the input signal to the addressing electrode 30 of a particular nozzle in a printhead. In the pulses shown in FIG. 5, the gradual decrease of each ramped firing pulse VA is linear, but, as will be apparent below, a non-linear decrease may also be provided as needed for particular situations.

The firing pulses VA are combined in comparator 100 with a relatively constant bias voltage VB, shown by the dotted line generally intersecting with the pulses VA in the top waveform of FIG. 5. The constant voltage VB has a magnitude which is related to a sensed temperature of each particular nozzle in the printhead. The constant voltage VB may be derived from a thermistor 102, which may be placed on the printhead in the vicinity of each nozzle.

Comparator 100 is adapted to produce a constant voltage output when the VA input is greater than the VB input; therefore, an output pulse from comparator 100 will begin with the initial steep increase with each pulse VA, and last until the gradually decreasing value of VA becomes less than the value of VB, as is illustrated by the lower waveform VC in FIG. 2. If VB is relatively high, that is, so that the dotted line VB is toward the points of the firing pulses in the VA waveform, it will follow that VA will exceed VB for only a short period of time within each cycle. Conversely, if VB is relatively low, toward the bases of the pulses in VA, a relatively large proportion of the cycle time of the VA pulses will be in a condition where VA is greater than VB. This duration of VC is the duration of input pulses sent to the electrode 30 and heating element 26 for a given ejector 10. In this way, the sensed temperature, translated into a value VB, is used to obtain a suitable pulse width.

In order to normalize the value of VB so that it will interact properly with the ramped firing pulses VA, the voltage applied to thermistor 102 may be varied. During initialization of the system, a pin associated with thermistor 102 may be directed to a shift register and a digital to analog decoder which supplies the voltage to the thermistor 102, while another pin may be directed to supply clock pulses to the shift register. With such a digital system, it is necessary only to input a digital word related to the sensed temperature, and then allow the digital to analog converter to provide the needed analog voltage to the thermistor 102. This varying of the voltage to the thermistor may be accomplished by adding an extra pin to each nozzle in the printhead, or alternately, the input to the thermistor can share the pin for the VA input. In the latter case, steering logic may be used to return the pin to its function receiving VA and the shift register would store the word giving the temperature.

As is apparent from the above, the most important characteristics of the output of the system of the present invention are the amplitude and time duration of each firing pulse VC to the respective heating elements 26 in each of the nozzles. This output is dependent on the magnitude of VB relative to the ramped fire pulses VA. Obviously, the value of VC depends not only on the magnitude of VB but the specific shape of the ramped fire pulses VA. In particular, the most crucial feature of each fire pulse VA is the shape and steepness of the ramped portion of each fire pulse after the initial steep increase. The trailing portion of each pulse VA may vary in both slope and curvature. However, the shape of each ramped firing pulse VA must be related to the temperature response of the ink jet itself; that is, the shape of the firing pulse VA can be synthesized to correspond to a desired function of spot size versus temperature.

Figure 6:
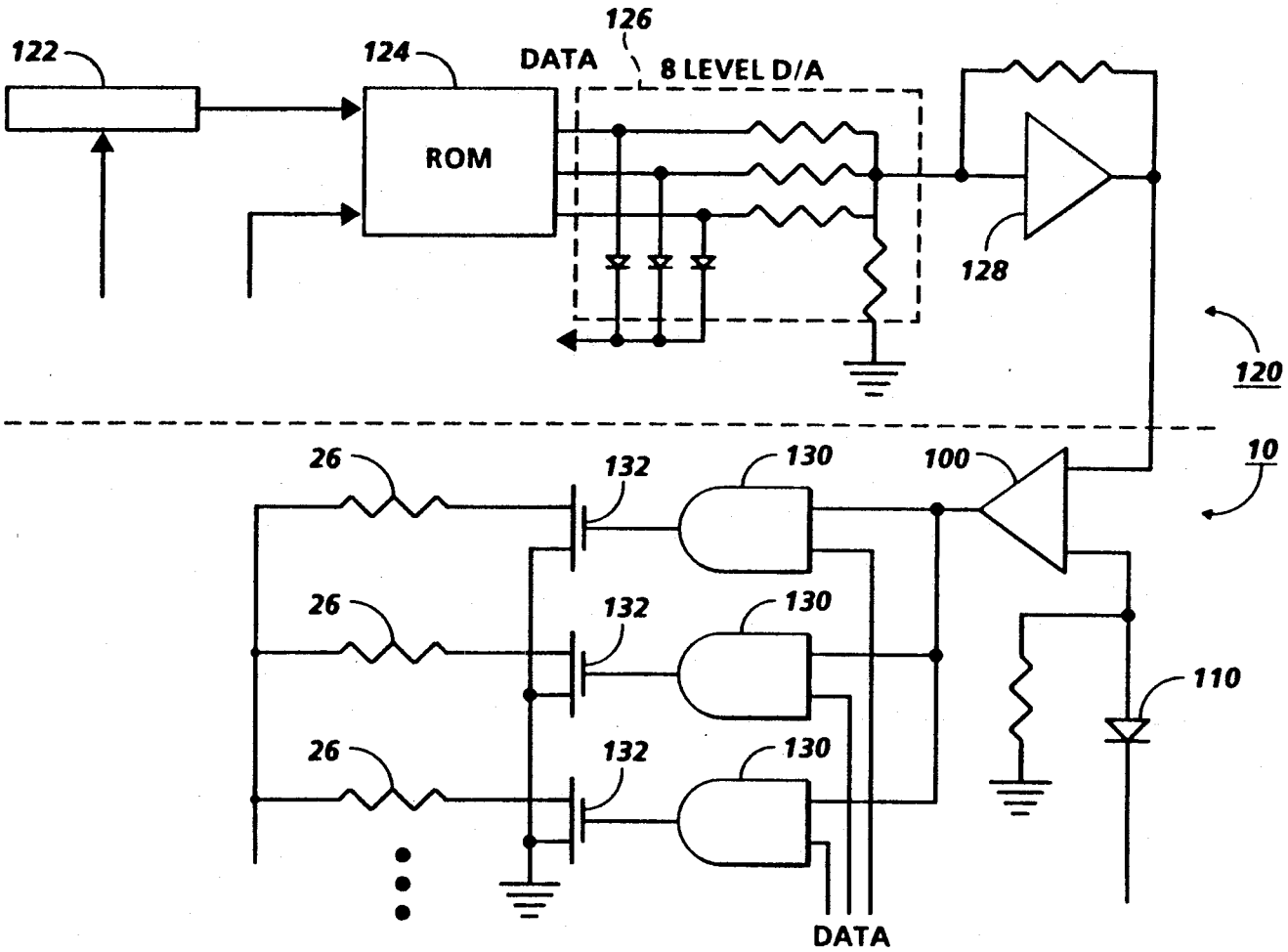
FIG. 6 is a simplified schematic diagram showing an electronic circuit that provides a ramped firing pulse VA of a preselected desired shape and employs such a firing pulse in the operation of an ink jet printhead.

FIG. 6 shows the electronic circuit that accomplishes the tasks of providing a ramped firing pulse VA of a preselected desired shape and employing such a firing pulse in the operation of an ink jet printhead. It will first be noticed that the top half of the circuit as shown in the Figure, designated generally as system circuit 120, is applicable to an entire ink jet printing system, even one in which numerous die modules (chips) are in use simultaneously. In contrast, the lower portion of the circuit, generally designated as 10, represents the circuitry found in each chip of each printhead in the system. Thus, in each ink jet printing system, there may be only one circuit 120, and many circuits of the type indicated by 10. Each circuit 10, it will be noted, comprises not only an individual heating element 26 (compare the schematic picture of heating element 26 to the cross-sectional picture of the heating element 26 in FIG. 1), but also its own individual temperature sensing means, such as the preferred embodiment of thermistor 102 in series with diode 110. It is thus apparent that, while the shape of the firing pulse VA is the same for every single printhead in the system, each individual chip may sense temperature independently and vary the pulse width, through its individual comparator 100, accordingly.

The system circuitry 120 comprises, in its essential elements, a counter 122, a read-only memory (ROM) 124, preferably containing a selectable plurality of look-up tables corresponding to various sets of desired waveforms VA, a digital-to-analog converter generally indicated as 126, here shown as an eight-bit type, and an amplifier 128. Once again, this central circuitry is common to every chip in the system, and its output is the ramped fire pulses VA which are sent uniformly to every chip.

Circuitry 10 is that represented by each module in the system, and what is shown in FIG. 6 is the circuitry of a single module, itself having several hundred or more ejectors therein. The main portion of the circuitry is the comparator 100, in combination with thermistor 102 and diode 110, the function of which has been described in relation to FIGS. 4 and 5. The output VC from comparator 100 is here fed into a number of AND gates 130, each associated with one ejector 10 in the chip, each of which also accepts input digital data. This digital data will be on or off depending on whether that particular ejector need be activated to produce a given pixel of a desired image on the copy sheet. The question of the data being on or off, according to its location in the desired image, is the final input determining whether the particular ejector will be fired at a given time. Where there is no data coming into AND gate 130, the circuit will be broken between comparator 100 and heater 26. In this embodiment, instead of the output signal from AND gate 130 being used directly to power the heating element 26, the output of each AND gate 130 is used to activate a switching transistor 132, which in turn is used to control the energy applied to heating element 26. In this way, it may be convenient to isolate what may be an incongruous voltage to the heating element 26 from the rest of the circuitry.

When the system is in operation, central circuit 120 operates as follows. Fire pulses are entered into counter 122 with a regularity consistent with the operation of the printing process, that is, the motion of the printheads relative to the imaging surface such as a sheet of paper. The counter then transmits signals activating the ROM 124. Also entered into ROM 124 is a user selection of the desired spot size for the particular printing task. This spot size value may be dedicated as a function of the machine itself, or may be externally selected for particular purposes as well, such as for use with different types of copy sheet, as will be described below. Every time a pulse is entered by counter 122 into ROM 124, the ROM 124 outputs digital data consistent with a desired firing pulse VA. In the embodiment shown, the firing pulse will be expressed as a word of digital data. The actual shape of the waveform created by the digital data in the ROM will be predetermined by look-up tables in the ROM 124. The ROM 124 may in practice be a random access memory that is loaded with data before each run. The shapes of the VA pulses may be determined empirically, based on experimentation with the actual machine in use, which is loaded into the ROM 124 upon manufacture of the system. This empirically-derived data will generally relate to the necessary pulse width VC as a function of a sensed temperature for the desired spot size, such as the one selected by the user.

At the initialization of a fire pulse to counter 122, which typically occurs every 3 to 5 microseconds, the counter 122 outputs into ROM 124, which outputs an three-bit digital word into a fast digital-to-analog converter 126. Since the speed required in this apparatus is generally above that allowed by ordinary digital-to-analog converter chips, a custom digital-to-analog converter 126 is preferred. It is common that the output voltages of a ROM when the data is at logic high is not always of a consistent value. Therefore, a clipping circuit may be added to limit the amplitude of the output pulses from ROM 126 to a single value. The output from the resistor network forming part of digital analog converter 126 is weighted by the resistors, each being in a binary ratio, according to the digits inputted, and then the output is directed to a high speed operational amplifier 128. The final output of VA is then fed in parallel form simultaneously to every chip in the printhead, and fed into the respective comparator 100 in each nozzle, to yield the appropriate firing pulse VC in the manner described above.

In order to effect the firing of a droplet of ink from the printhead, a certain quantity of energy must be applied to the heating element 26. Basically, there are two parameters which can be varied to affect the transmission of heat energy to the ink: the voltage to the heating element 26, and the pulse width, that is, the time duration of the signal. FIG. 2*c* is an experimentally-derived graph illustrating the trade-off between voltage sent to the heating element 26 (the "burn voltage") and the pulse width. In the curves for each pulse width, the voltage is set to 10% above the threshold voltage at which drops begin to be ejected.

Figure 7:
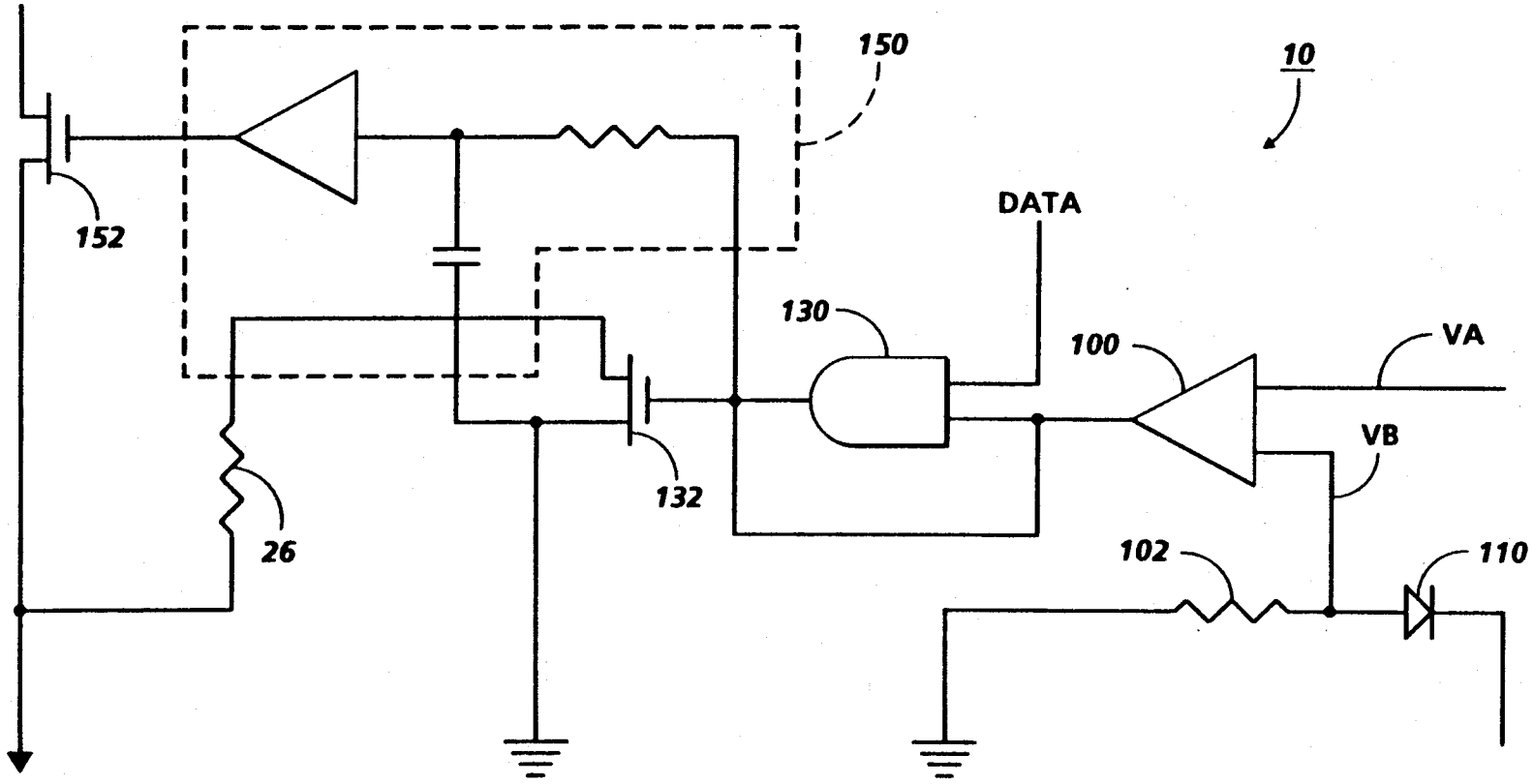
FIG. 7 is a schematic diagram of circuitry which may be implemented on an ink-jet printhead.

As mentioned above in connection with the previous embodiment of the invention, there is an incentive to extend the pulse width into heating element 126 as long as possible, consistent with printing speed, in order to afford a lower burn voltage. Thus, although it is possible to achieve the aims of this invention by maintaining the voltage at the value for the smallest required pulse width, the resulting overall excess energy input to the printhead is expected to reduce the operational lifetime of the printhead. FIG. 7 is a schematic diagram of circuitry which may be implemented on each chip of printhead 10, in order to take advantage of increasing pulse width at the expense of burn voltage. The circuit in FIG. 7 can be substituted for the circuit shown in the lower portion of FIG. 6, described above. In addition to those elements, however, the circuit of FIG. 7 includes an averaging circuit generally indicated as 150, which includes as its elements an RC circuit and an operational amplifier. The averaging circuit 150 outputs into the base of a large transistor 152, which forms a connection between a high voltage power supply and the heating element 26 of the particular chip. However, the high voltage power supply also sends energy to all of the other heating elements in the printhead, as needed. The function of averaging circuit 150, transistor 152, and the high voltage power supply (not shown) is to control the actual burn voltage to each heating element 26 in the chip. Thus, the magnitude of the voltage to the heating elements whenever a particular nozzle is fired will be maintained at a constant level regardless of the amplitude of ramped pulses VA or firing pulses VC.

In order to effect this compensation, the averaging circuit 150 ensures that the average value of the pulses VC from the comparator, which is proportional to the pulse width, is applied to the transistor 152 controlling the burn voltage. In this way, an exact correlation between the burn voltage and the pulse width may be maintained, thereby matching the relation of burn voltage versus pulse width, consistent with a preferably low burn voltage.

One advantage of this partially-analog embodiment of the invention is that it may be easily adapted for printheads wherein one portion of the printhead is likely to become hotter than another, such as with the full-width printhead example described above. Because VA reflects the temperature-responsive characteristics of all the ejectors for a given situation, and VB represents the locally-sensed temperature for a specific ejector (or group of ejectors, as on one chip in a full-width printhead) at a precise time, VB is just a number "filled in" to the equation reflected by VA. Thus, the VA signal train may be output to all ejectors in a printhead at the same time, and the values of VB may be specific to certain ejectors in response to the locally-sensed temperature along the printhead. So, while the whole printhead receives the VA signal, VB may vary among the various chips in the printhead, but the resulting VC for each chip will always be the correct one for the specific chip.

When selecting a temperature-sensitive device such as thermistor 102 for use in any embodiment of the present invention, it is desirable that such a temperature-sensitive device be manufactured right into the printhead, for example, onto the silicon chip of substrate 28. Of devices which could be incorporated into substrate 28 during fabrication of the printhead, one is a reverse-biased diode, such as shown as 110 in FIG. 5. The current of such a device is exponentially dependent on temperature. The combination of thermistor 102 and diode 110 yields a highly sensitive sensor, since the thermistor 102 has a thermal coefficient which supplements the coefficient of the diode 110. The value of the thermistor 102 can be adjusted to provide a suitable match to the effective resistance of the diode 110, preferably equal to that resistance. Diode 110 can either be a straightforward n/p or p/n diode, a Shottky diode, or even the diode which exists between the accumulated channel of a NMOS device and a p-type substrate. When such a diode is used, the thermistor 102 may be a diffused poly resistor, an n-drift resistor, or a transistor with its source connected to a gate. Each of these devices can be incorporated into the standard processing of the die with suitably designed masks to form a monolithic integrated printer die. In operation, thermistor 102 and diode 110 are connected in series, between a constant voltage source and ground, to the comparator 100. In summary, the temperature sensor may be a single sensor or two different sensors in series. What is important is that any nonlinear characteristics of the output of the sensor are taken into account by the system, and are most conveniently incorporated into the underlying equations by which the values in the look-up tables are obtained.

In the preferred embodiment of the invention, the temperature-sensitive device should be incorporated into the chip, in close proximity to the heating elements. It has been found that a polysilicon thermistor can be located approximately 4 mils away from the heater bank and is thus very sensitive to thermal conditions at the heater. It has a positive thermal coefficient of resistance (TCR), ~1E-03. Also useful is a drift thermistor, located ~0.1" away from the heater bank. The drift thermistor is less sensitive to the thermal environment of the heaters but it has the virtue that its positive TCR is high, ~5E-03.

In addition to the temperature of the ejector and the variety of printing conditions mentioned above, other considerations may be taken into account. Many of these considerations relate to the visual effect of a given spot size in the context in the certain types of images, particularly in the formation of half-tones, or with color thermal ink jet printing. In a perfect case, the perceived "darkness" of an area in an image (such as, for example, a photograph of a face) will be linearly related to the amount of ink placed on the paper by the ink jet. Since the eye sees equal density steps as about equal values, then false contouring would be minimized. If the relationship between the placement of ink on the paper and the perceived optical darkness were not linear, then the large steps would likely appear as lines in places of the reproduced document where uniform density changes occur, resulting in an inaccurate rendition of the original image.

However, in practice, it often occurs that the range of tonal values in the original exceeds that in the reproduced copy. In such a case, tonal compression (adaptation of the tonal values of the original to the tonal value capable of being printed with a particular ink jet apparatus) is needed. Tonal compression can be done in software by the following method: since the input data is optically scanned with, typically, 256 gray levels per color per dot, the compression can be done by merely selecting which scanned tone in the original corresponds with which of the 64 tones that can be printed. However, this method makes no change in the actual level of the tones reproduced, only the selection of which tone is reproduced for which range of tones in the original; the main purpose is to adjust the selected levels so that no contouring is apparent. However, it happens that under dim lighting conditions, the tones above the midtone point appear compressed due to the fact that the eye no longer follows the logarithmic rule and instead goes over to a $\frac{1}{3}$ power law, in which case the measurement of the eye's response is called "lightness". Thus, in these dim lighting conditions, it is necessary to depart from the linear relation and go over to another response, such as one of those described by the broken-line curves in the graph, to obtain a more "realistic" final result in the printed document.

This non-linear response for advantageously rendering certain originals can be incorporated into one or more look-up tables in ROM 124. The actual wave shapes of the ramp pulses VA in order to take into account this optical peculiarity can be programmed into the ROM based on empirical data.

Another special case conducive to its own look-up table would be a special look-up table to be used when the apparatus is started after a period of dormancy. When an ink jet head is not used for a period of time, the ink jets tend to plug up because of evaporation of water in the ink. This plug formed by dried ink can be removed by turning on the heater 26 for a finite period of time, although not at a sufficient temperature to cause emission from the nozzle, to raise the temperature of the ink so that the solid portion of the ink in the ejector 10 is redissolved into the liquid ink and then removed by shooting the jet. Thus, the system of the present invention lends itself to this method of clearing with only an additional look-up table entry needed.

The advantages and novelty of the present invention can be summarized as follows:

First, previous thermal ink jet control systems attempt to produce a constant temperature of the printhead either by heating the thermal ink jet heater in a unique way or by using supplementary heaters in the printhead. The present invention does not control temperature, but rather adapts the input signal to the heating element within each nozzle of the printhead in response to a sensed temperature.

Secondly, the circuitry of the present invention is readily conducive to placement on the printhead chip. Heretofore, it has been most common to put the control circuitry for the printhead on a separate chip. Also, the present invention allows for a relatively simple incorporation of temperature-sensitive devices for each die module of a multi-module printbar, since the temperature-sensitive element associated with each module affects only that module, and thus the use of numerous lines to a central control circuit is avoided. Each individual module in a printbar essentially sets its own operating characteristics on the basis of its own temperature.

Thirdly, the present invention allows selection of spot size or compensation for other factors, such as modules with different characteristics, merely by selecting certain software from an electronic look-up table. Because of the versatility of the printhead for various situations is embodied in software, the user has wide latitude in selecting an appropriate look-up table for optimum document quality.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A method of controlling an ink jet printing apparatus for propelling ink jet droplets on demand from a printhead having a plurality of drop ejectors, each ejector having a heating element actuable in response to electrical input signals selectably applied to the heating element to produce a temporary vapor bubble and cause a quantity of ink to be emitted for the creation of a mark on a copy sheet, comprising the steps of:

sensing the temperature of ink in the printhead, and generating a signal indicative thereof;

selecting a combination of power level and time duration of the electrical input signal for the heating element to result in a desired size of the mark on the copy sheet, by selecting, in response to the signal from the sensing means, a duration of the electrical input signal for the heating element consistent with a desired size of the mark on the copy sheet, and selecting a power level consistent with the selected duration of the electrical input signal to produce the temporary vapor bubble; and actuating the heating element according to the selected combination of power level and time duration.

2. A method as in claim 1, wherein the selecting step comprises the step of selecting the duration of the electrical input signal as a function which relates to the temperature-sensitive characteristics of the ink.

3. A method as in claim 1, wherein the selecting step comprises the step of selecting the duration of the electrical input signal as a function which relates to the temperature-sensitive characteristics of the means for sensing the temperature of ink in the printhead.

4. A method as in claim 1, wherein the selecting step comprises the step of selecting the duration of the electrical input signal as a function which relates to the properties of the copy sheet.

5. A method as in claim 1, wherein the selecting step further includes the step of entering the selected duration into a function relating the selected duration to the consistent power level, with the function being substantially insensitive to the temperature of the liquid ink.

6. A control system for an ink jet printing apparatus for propelling ink jet droplets on demand from a printhead having a plurality of drop ejectors, each ejector having a heating element actuable in response to electrical input signals selectably applied to the heating element to produce a temporary vapor bubble and cause a quantity of ink to be emitted for the creation of a mark on a copy sheet, comprising:

means for sensing the temperature of ink in the printhead, and generating a signal indicative thereof;

means for selecting a combination of power level and time duration of the electrical input signal for the heating element to result in a desired size of the mark on the copy sheet, the selecting means including means for selecting, in response to the signal from the sensing means, a duration of the electrical input signal for the heating element consistent with a desired size of the mark on the copy sheet, and means for selecting a power level consistent with the selected duration of the electrical input signal to produce the temporary vapor bubble; and means for actuating the heating element according to the selected combination of power level and time duration.

7. A control system as in claim 6, wherein the means for selecting a combination of power level and time duration of the electrical input signal includes a plurality of look-up tables responsive to the signal from the sensing means.

8. A control system as in claim 6, further including means for causing the ink in the printhead to rise to a predetermined temperature without causing ink to be emitted.

9. A control system as in claim 6, wherein the sensing means senses the temperature of the ink in the printhead following a regular number of cycles of emission of ink from the printhead.

10. A control system as in claim 6, further including a plurality of sensing means for sensing the temperature of ink in the printhead, and wherein the selected combination of power level and time duration based on the signal from each sensing means is applied to the ejectors generally adjacent to each sensing means.

11. A control system as in claim 6, wherein the means for selecting a duration of the electrical input signal operates according to a function which relates to the temperature-sensitive characteristics of the ink.

12. A control system as in claim 6, wherein the means for selecting a duration of the electrical input signal operates according to a function which relates to the temperature-sensitive characteristics of the means for sensing the temperature of ink in the printhead.

13. A control system as in claim 6, wherein the means for selecting a duration of the electrical input signal operates according to a function which relates to the properties of the copy sheet.

14. A control system for an ink jet printing apparatus for propelling ink jet droplets on demand from a printhead having a plurality of drop ejectors, each ejector having a heating element being actuable in response to electrical input signals selectably applied to the heating element to produce a temporary vapor bubble and cause a quantity of ink to be emitted for the creation of a mark on a copy sheet, comprising:

means for producing a ramp signal of a preselected voltage profile over time;

means for sensing the temperature of ink in the printhead, and generating a signal indicative thereof;

means, in communication with said sensing means, for producing a constant voltage as a function of the signal from the sensing means; and comparator means for comparing the ramp signal and the constant voltage and producing an electrical input signal of a duration relating to the relative values of the ramp function and the constant voltage; and means for selecting a burn voltage suitable for actuating the heating element so that the drop ejector will propel an ink droplet when the electrical input signal is of a duration determined by the comparator means.

15. A control system as in claim 14, wherein the constant voltage is within a range comparable to the magnitude of the profile of the ramp signal.

16. A control system as in claim 14, wherein the comparator means produces an input signal of a time duration equal to the duration wherein the amplitude of the ramp signal is greater than the constant voltage.

17. A control system as in claim 14, wherein said producing means produce a ramp signal having a profile which rises substantially instantaneously from a base voltage to a maximum voltage and then decreases to the base voltage.

18. A control system as in claim 17, wherein said producing means produce a signal having a profile which decreases to the base voltage according to a function which relates to the temperature-sensitive characteristics of the ink.

19. A control system as in claim 17, wherein said sensing means sense the temperature of the ink in the printhead, and wherein said producing means produce a signal having a profile which decreases to the base voltage according to a function which relates to the temperature-sensitive characteristics of the means for sensing the temperature of ink in the printhead.

20. A control system as in claim 14, wherein said producing means include means for outputting a digital signal consistent with the preselected voltage profile over time.

21. A control system as in claim 20, wherein said producing means include an electronic look-up table.

22. A control system as in claim 20, wherein said producing means include a plurality of selectable electronic look-up tables.

23. A control system as in claim 14, wherein said producing means include a digital-to-analog converter for converting the digital signal to an analog signal and outputting the analog signal to the comparator means.

24. A control system as in claim 14, further comprising means for increasing the duration of the input signal, thereby lowering the necessary voltage amplitude applied to the heating element.

25. A control system as in claim 14, wherein said increasing means include means for integrating the input signal for the heating element.

* * * * *